US005329795A

United States Patent [19]

Sartorio et al.

[11] Patent Number: 5,329,795

[45] Date of Patent: Jul. 19, 1994

[54] PRECISION BENDING PRESS FOR RELATIVELY SHORT PIECES OF SHEET METAL

[75] Inventors: Franco Sartorio; Stefano Vergano, both of Torino, Italy

[73] Assignee: Amada Company, Ltd., Isehara, Japan

[21] Appl. No.: 982,995

[22] Filed: Nov. 30, 1992

[30] Foreign Application Priority Data

Dec. 30, 1991 [IT] Italy ..... T091A001051

[51] Int. Cl.[5] ..... B21J 13/04

[52] U.S. Cl. ..... 72/21; 72/389; 72/456; 100/231

[58] Field of Search ..... 72/21, 27, 31, 389, 72/413, 446, 453.02, 453.06, 453.07, 453.08, 481, 456; 100/231, 258 R, 258 A

[56] References Cited

U.S. PATENT DOCUMENTS 3,327,515 6/1967 Beyeler .
3,677,009 7/1972 Thatcher ..... 60/97 E
5,077,998 1/1992 Santorio ..... 72/21

FOREIGN PATENT DOCUMENTS 3943347 5/1990 Fed. Rep. of Germany .
2650770 2/1991 France .
411755 11/1965 Switzerland ..... 72/389
2226515 7/1990 United Kingdom .
7900805 10/1979 World Int. Prop. O. ..... 72/389

*Primary Examiner*—David Jones
*Attorney, Agent, or Firm*—Dominik, Stein, Saccocio, Reese, Colitz and Van Der Wall

[57] ABSTRACT

A precision bending press for relatively short pieces of sheet metal includes a pair of tool-holder beams one of which is movable towards the other in order to follow a working path in the general common plane of the beams. The movable beam is subdivided, at least virtually, into a number n of segments and is controlled by a plurality of actuators of a number at least equal to n+1. The actuators are connected to a reaction structure stressed by the overall forming force created by the actuators. The actuators are controlled by means of a processing unit which receives signals indicative of the relative punch—die position generated by position transducers supported by an auxiliary structure which is not affected substantially by the deformations of the reaction structure caused by the bending force. The reaction structure comprises a single pair of lateral uprights connected to one another by a connecting beam and by the fixed tool-holder beam. Each actuator exerts the forming force between the connecting beam and the movable beam.

11 Claims, 7 Drawing Sheets

PRECISION BENDING PRESS FOR RELATIVELY SHORT PIECES OF SHEET METAL

DESCRIPTION

The present invention relates to a bending press for sheet metal, and in particular, a bending press for bending relatively short pieces.

A press of this type is known from Italian application 68166-A/88, which corresponds to U.S. Pat. No. 5,012,661, filed by the same Applicant. From this document a large-scale press provided with a movable beam subdivided into a plurality of segments is known. The subdivision of the movable beam into segments enables the bending deformations of the beam, caused by the bending load, to be limited or, for the same maximum permissible deformation, enables the dimensions of the beam to be limited.

The working path of the movable beam is controlled by a plurality of actuators, two of which are disposed at the ends of the beam and the remaining one or ones are disposed in the area of transition between two adjacent segments. A position transducer which measures accurately the momentary distance between the punch and the die, corresponding to the respective actuator, is associated with each actuator. All the actuators are controlled by a processing unit which receives the signals output by the position transducers and controls the actuators in such a manner that they impart identical displacements and displacement speeds to the beam.

In this known press, each actuator is supported by a robust C-shaped upright; these uprights together constitute a reaction structure which absorbs the overall bending force generated by the actuators. Each upright is independent of the others, and is freely deformable under the bending force generated by the respective actuator, without this deformation affecting the other uprights. The position transducers are supported by an auxiliary structure which is independent of the reaction structure in order to ensure that the measurements made by the position transducers are independent of the deformations of the reaction structure caused by the working load of the actuators.

The fact that the reaction structure is constituted by a plurality of uprights associated with respective actuators represents an optimum solution from the point of view of distribution of the forces, and consequently of the deformations induced by the bending load. However, this known solution has the disadvantage of being rather costly and, in addition, the intermediate uprights impede access to the rear part of the press.

The aim of the present invention is to provide an improvement of a known press of the above-described type, suitable in particular for bending relatively short pieces, and which allows the aforementioned disadvantages to be overcome.

According to the invention there is provided a bending press, in which the reaction structure includes a single pair of lateral uprights connected to one another by a connecting beam and by the fixed tool-holder beam, and in which each actuator exerts the bending force between this connecting beam and the movable beam.

In the solution according to the invention, the connecting beam is deformed under the effect of the working loads of the individual actuators and each of these is affected by the deformation of the connecting beam. However, the measuring system of the displacements and control of the actuators are accurate and fast enough to compensate instantaneously for the error which would be induced by deformation of the connecting beam.

In the press according to the present invention, the rear part of the machine is substantially clear and this enables an automatic tool change device to be disposed on the rear part of the press.

Further characteristics and advantages of the present invention will become apparent from the following detailed description, given with reference to the appended drawings which are provided purely by way of non-limiting example, in which.

Figure 1:
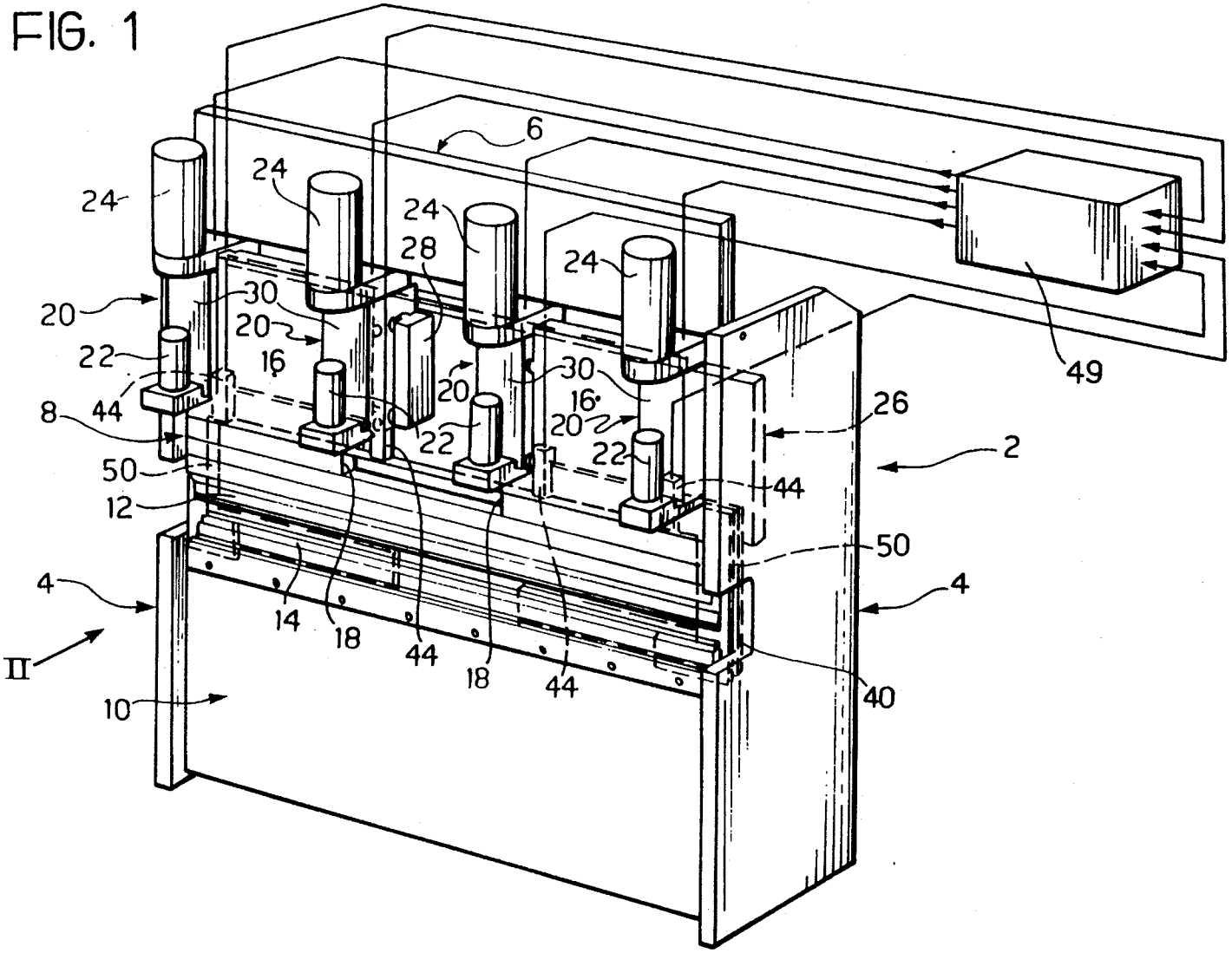
FIG. 1 is a schematic perspective view of a press according to the present invention.
Figure 2:
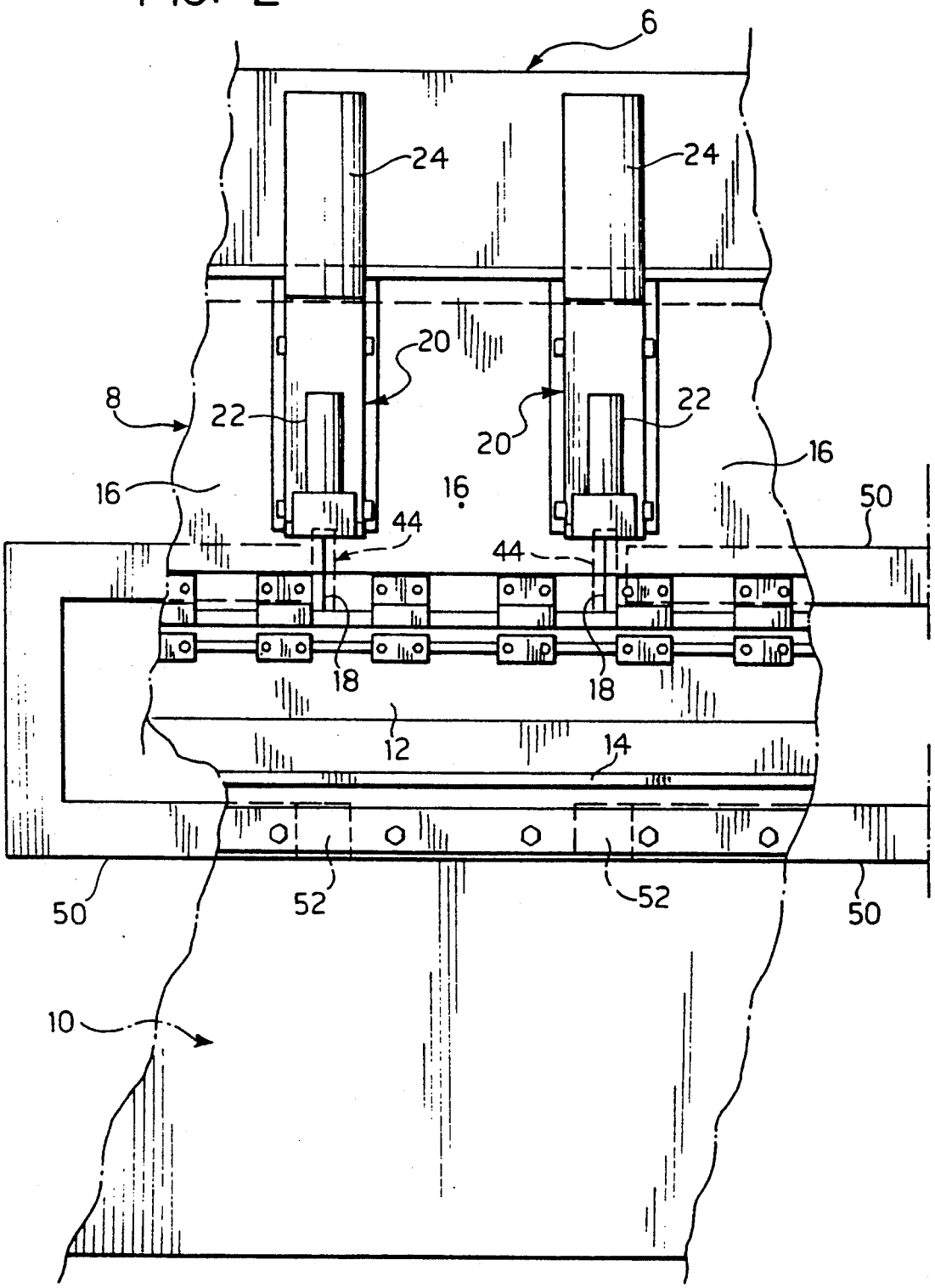
FIG. 2 is a partial view on the arrow II of FIG. 1.
Figure 3:
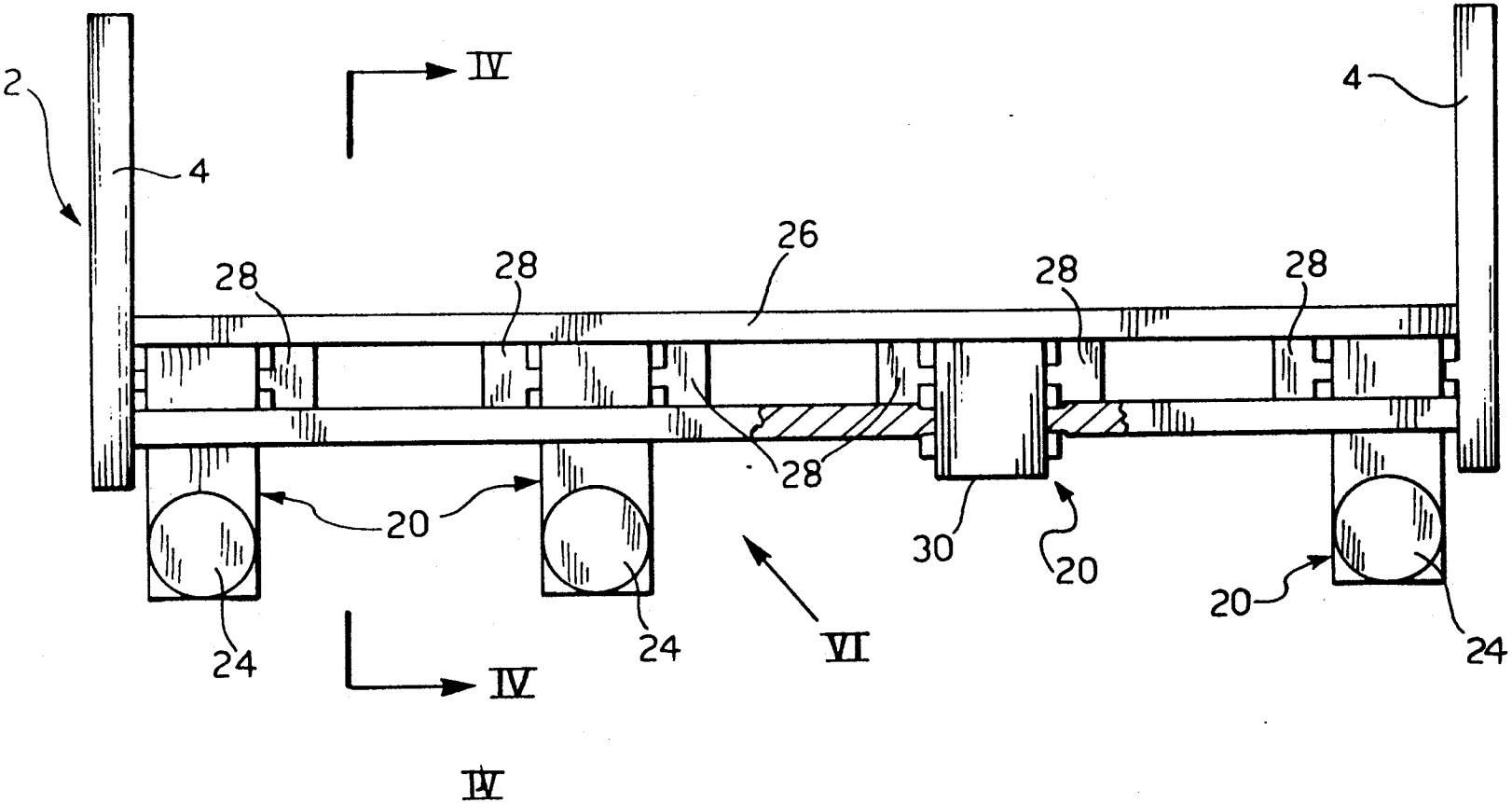
FIG. 3 is a plan view of the machine shown in FIG. 1.
Figure 4:
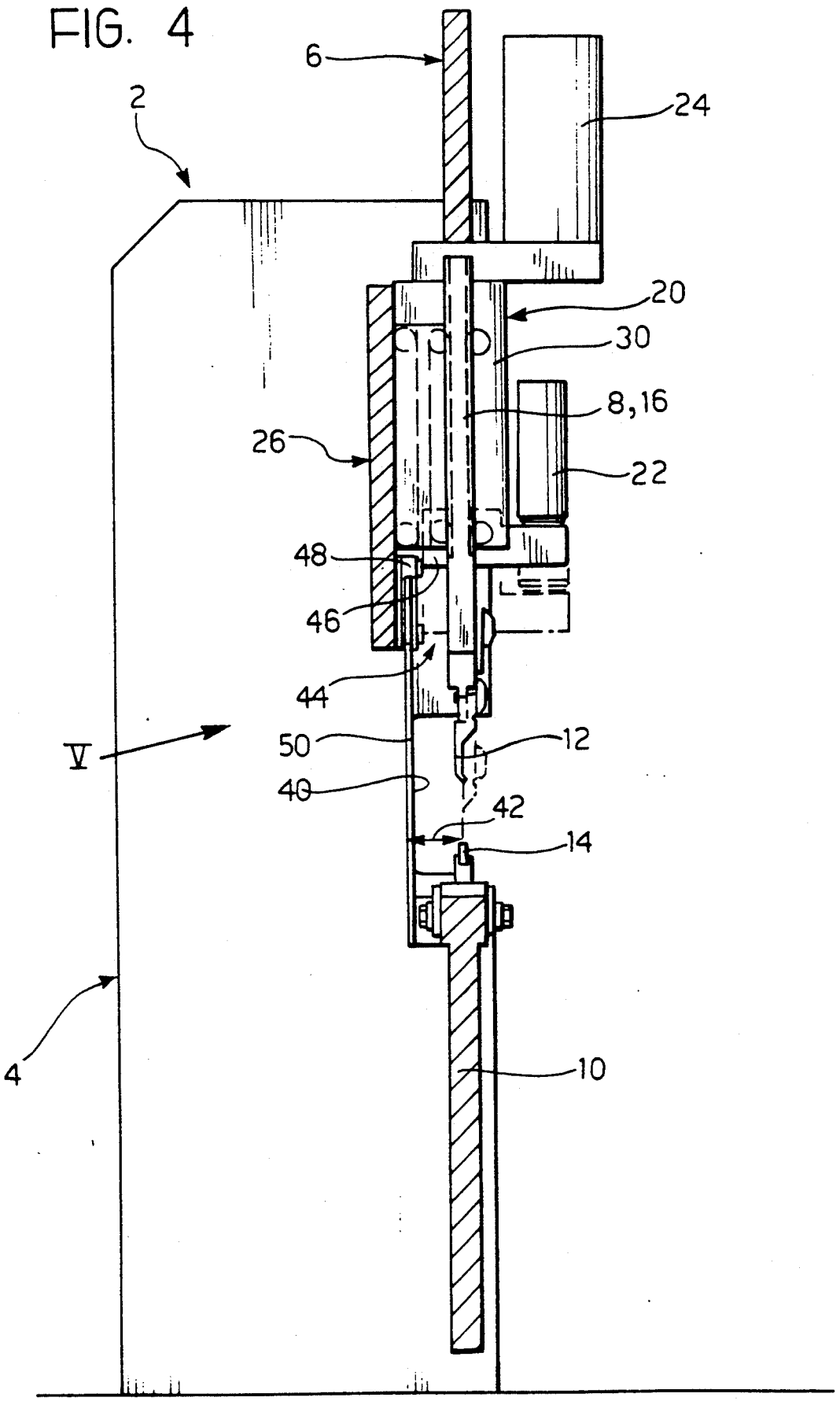
FIG. 4 is a cross-section along the line IV—IV of FIG. 3.

With reference to FIGS. 1 to 4, a bending press includes a reaction structure 2 formed essentially by a pair of lateral uprights 4 consisting of robust steel beams connected to one another at the top by a connecting beam 6. Two tool-holder beams 8, 10 are disposed between two lateral uprights 4 arranged in a general common plane which coincides with the plane of the connecting beam 6. The lower beam 10 is fixed and is integral with the lateral uprights 4, whereas the upper beam 8 is movable vertically in the common plane. A bending punch 12 and a die 14 are attached in conventional manner to the tool-holder beams 8, 10.

The upper tool-holder beam 8 is subdivided into a plurality of segments 16, each of which has a general overturned T configuration. In the example of embodiment shown in the drawings, the segments 16 consist of separate modules; alternatively, the segments 16 could be separated only virtually from one another and in this case the area of separation between two adjacent segments 16 (indicated as 18 in FIG. 2), must have a modulus of bending resistance in the general common plane of the tool-holder beams 8, 10 which is substantially lower than that of the remaining part of the beam 8.

The lower tool-holder beam 10 is made in a single piece and has dimensions which are sufficiently robust to be able to support the bending load without excessive deformations. The lower tool-holder beam can be connected to the lateral uprights 4 by means of an isostatic restraint system, in order to avoid transmitting the deformations of the lower beam 10 to the uprights 4.

Movement of the upper beam 8 is controlled by means of a plurality of actuators 20, two of which are disposed at the ends of the beam 8, and the remainder of which are disposed between two adjacent segments 16. The number of actuators 20 is thus higher by one unit than the number of segments 16 which constitute the beam 8.

The actuators 20 are preferably of the type described in Italian application 68065-A/90, which corresponds to PCT Application WO-92/12362, filed by the same applicant. As can be seen in greater detail in FIGS. 5 and 5A, each actuator 20 is provided with a first electric motor 22 which controls the approach and withdrawal travel of the beam 8 without a load, and with a second electric motor 24 which controls the bending stroke of the beam. Each actuator 20 applies the working load between the connecting beam 6 and the tool-holder beam 8 . The movable beam 8 is guided in a vertical direction A (see FIG. 5) contained in the general common plane of the tool-holder beams 8, 10. The actuators 20 are also guided in the same direction A of movement of the upper beam 8.

Figure 5:
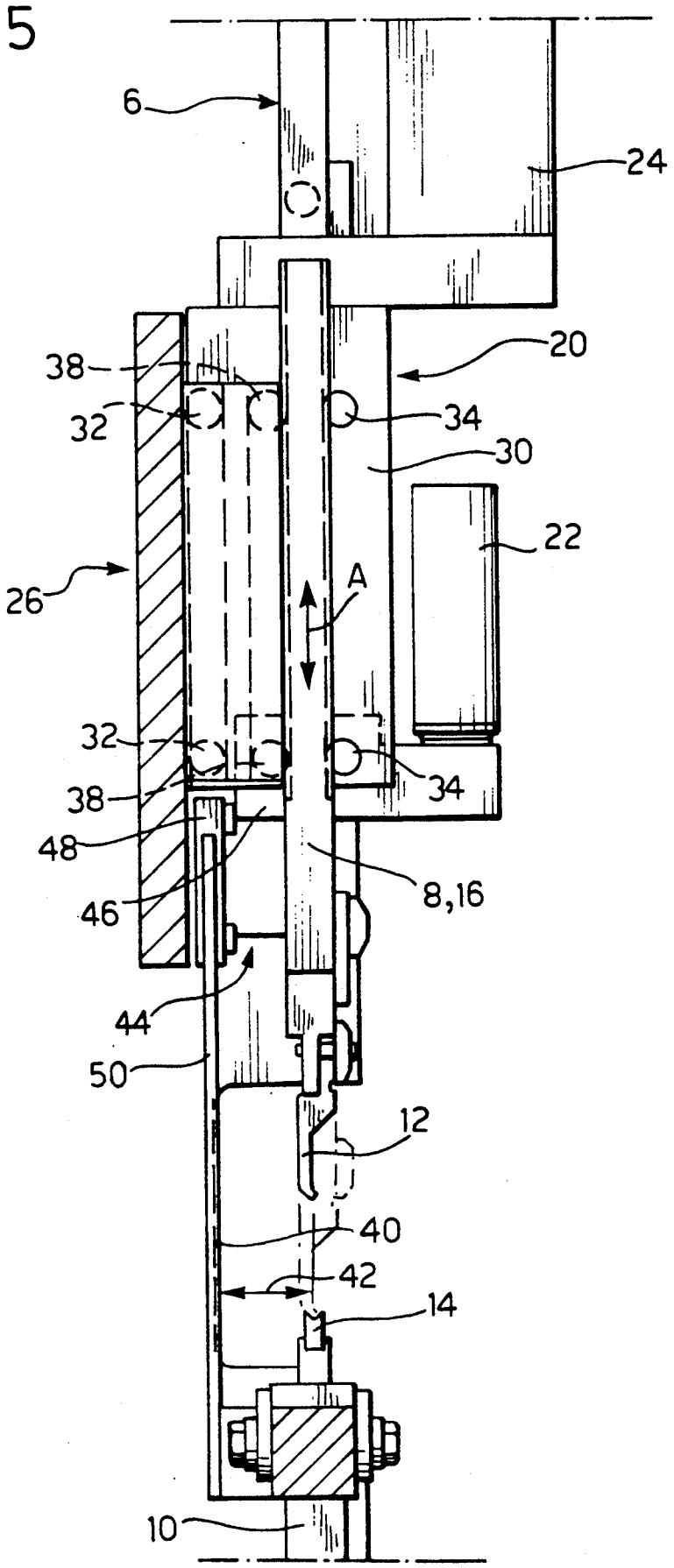
FIG. 5 is a lateral cross-section on an enlarged scale of the part indicated by arrow V in FIG. 4.
Figure 6:
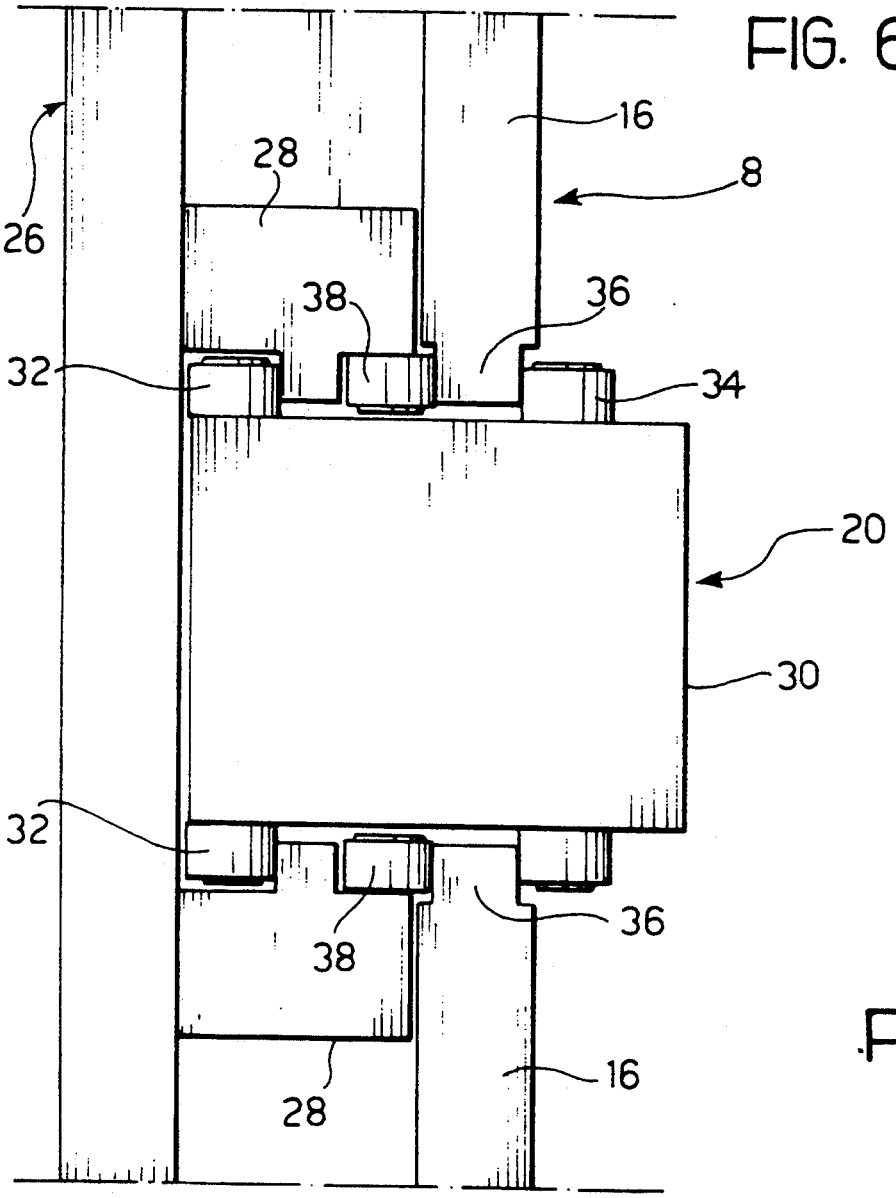
FIG. 6 is a plan view on an enlarged scale of the part indicated by arrow VI in FIG. 3.
Figure 5A:
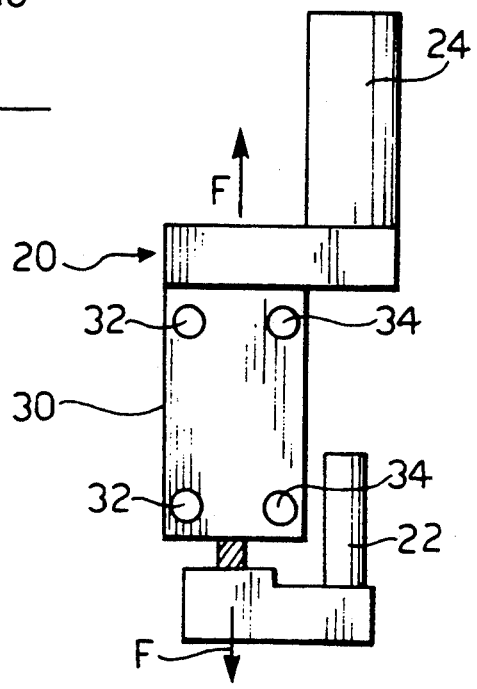
FIG. 5A is a schematic lateral view of an actuator used in the press according to the invention.

FIGS. 5 and 6 show by way of example a particularly advantageous solution for obtaining the guiding of the beam 8 and of each actuator 20. The structure which acts as a guide for the actuators 20 and the beam 8 is constituted by a fixed guide beam 26 connected at its ends to the lateral uprights 4 and extending parallel to the common plane of the tool-holder beams 8, 10. For each actuator 20, a pair of guides 28, along which the body 30 of each actuator 20 is slidable by means of a first set of wheels 32, is attached to the beam 26. The body 30 of each actuator 20 carries a second set of wheels 34 which act against end portions 36 of two adjacent segments 16 of the movable beam 8. A third set of wheels 38 is carried by the guide elements 28, and acts against the end portions 36. In this manner the elements 28 act as a guide both for the actuators 20 and for the segments 16 of the beam 8. Each actuator 20 is connected to the connecting beam 6 and to the movable beam 8 by means of a restraint system (not shown) which allows full freedom of movement in all directions except in the vertical direction A. In this manner the guide system for the movable beam 8 is independent of the system which applies the load to the beam.

The working load generated by the actuators 20 is absorbed by the reaction structure consisting of the lateral uprights 4 and of the connecting beam 6. The beam 6 is preferably connected to the lateral uprights 4 by means of an isostatic-type restraint system constituted by, for example, a pair of ball joints (not shown), one of which is free to move along the line joining the centers of the two joints. A connection system of this type ensures that the lateral uprights 4 are subjected only to traction, in order to keep the deformation to a minimum.

The lateral uprights 4 are disposed outside the working area, which enables the dimensions of the discharge grooves 40 to be reduced (FIGS. 4 and 5), in comparison with conventional presses, in such a manner that bending deformations of the uprights 4 are reduced. In fact, in conventional presses, the uprights are disposed inside the working area and the depth 42 of the discharge grooves 40 must be at least equal to the width of the maximum bending thickness of the piece. In the solution according to the present invention, the discharge grooves 40 are only intended to allow the piece to be removed from the punch along the bending line, if the piece cannot otherwise be removed otherwise from the punch 12 owing to a complex bending shape.

Low bending stress in the uprights 4 is essential in order to minimise the deformation of the guide beam 26.

A position transducer 44 (FIG. 2) which measures the vertical path of the punch 12 and indicates accurately the distance between the punch 12 and the die 14 is associated with each actuator 20. The position transducer 44 is constituted, for example, by an opto-electronic reader 46 attached to the movable beam 8 and facing a vertically movable optical line 48 carried by the guide beam 26. The position transducers 44 generate signals which indicate the distance between the punch and the die in correspondence with the respective actuators 20. These signals are transmitted to a processing unit 49 (FIG. 1) which controls the electric motors 22, 24 of the actuators 20 in such a manner that the distance between the punch and the die is the same in correspondence with each transducer 44. Thus, the bending path of an actuator 20 may be slightly different from that of the other actuators, so as to compensate for any differences in deformation of the connecting beam 6. The accuracy of the measuring system and the speed of reaction of the control system are high enough to compensate instantaneously for such deformations. This is essential in order to ensure that the machine is accurate and that the system of measuring the distance between the punch and the die is not affected either by the deformations of the lower beam or by the deformations of the reaction structure which absorbs the working load generated by the actuators 20. In the example of embodiment illustrated in FIGS. 1 to 6, the fixed part of each position transducer 44 is supported by a C-shaped bracket 50, of which one end 52 is attached to the lower tool-holder beam 10 in correspondence with the upright which passes through the position transducer 44. According to a characteristic of the present invention, the C-brackets 50 are disposed on a vertical plane parallel to the general common plane of the tool-holder beams 8, 10. This layout prevents space from being taken up on the rear part of the press. As can be seen in the plan view in FIG. 3, the working area in the rear area of the press is completely free, since the uprights 4 are disposed outside the working area. The rear part of the machine can thus be used to accommodate an automatic device for changing the forming tools 12, 14.

Figure 7:
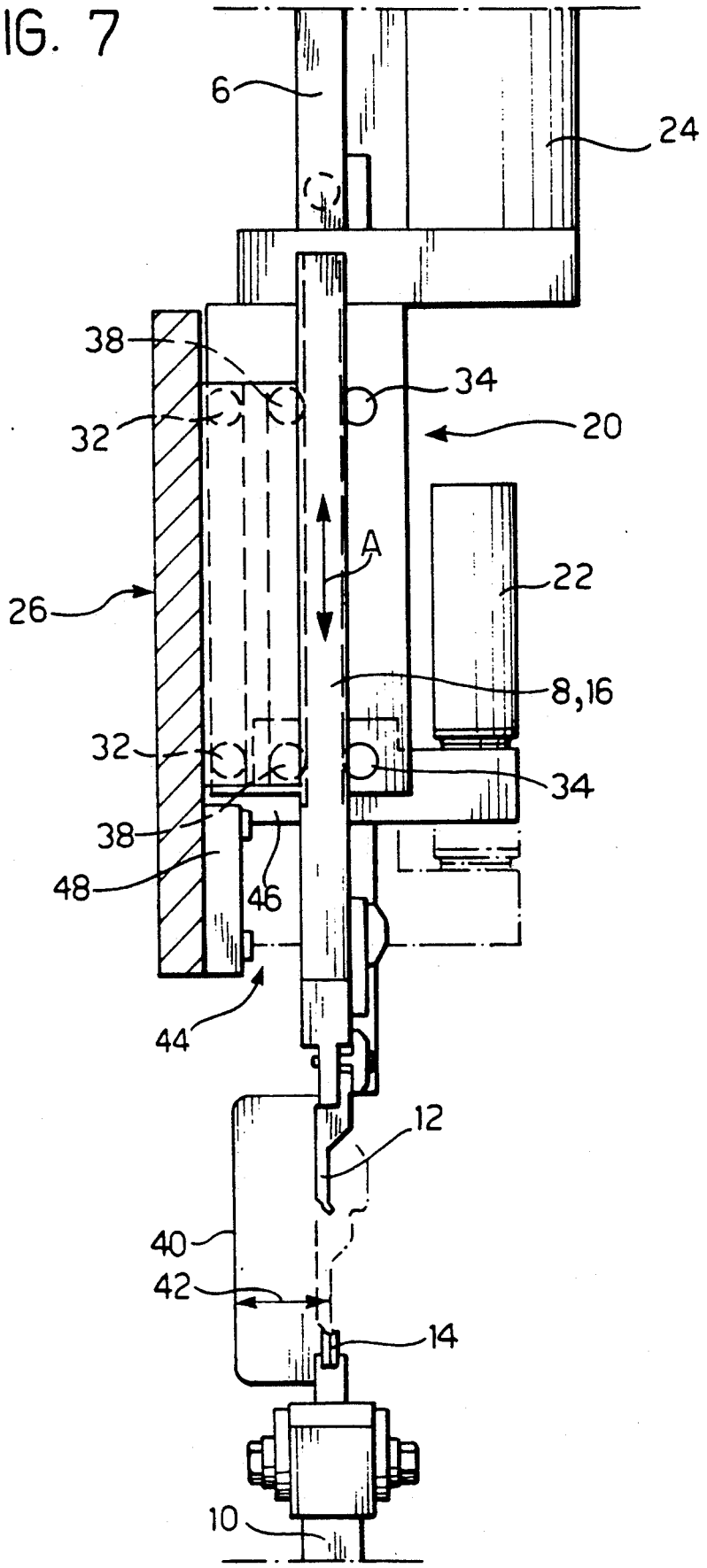
FIG. 7 is a cross-section similar to FIG. 5 showing a variant of the present invention.

In the embodiment shown in FIG. 7, the fixed part 48 of each position transducer 44 is attached to the guide beam 26. Owing to the low bending stress on the uprights 4 with which the beam 26 is integral, it can be considered that the beam 26 is not affected significantly by deformations of the reaction structure, caused by the working load of the actuators 20.

What is claimed is:

1. A bending press for sheet metal, comprising:

a reaction structure comprising a single pair of lateral uprights connected to one another by a connecting beam;

at least one fixed tool-holder beam and at least one movable tool holder beam, said tool-holder beams attached to said lateral uprights and disposed in a general common plane, said movable tool holder beam movable towards said fixed tool-holder beam in order to follow a working path in said plane, one of which tool-holder beams carries a die and the other of which carries a forming punch, and in which the movable tool-holder beam includes n segments, n being greater than or equal to 2, which under a working load can deform substantially independently from each other;

a plurality of actuators of a number equal to at least n+1 connected to, and for controlling the movement of, the movable tool-holder beam, the actuators being connected to the connecting beam of the reaction structure and said structure being stressed by the overall working load generated by the actuators;

an auxiliary structure which is not affected appreciably by deformations of the reaction structure caused by the working load;

a plurality of position transducers associated with respective actuators for generating signals which indicate the distance between the punch and the die and including means for sending said signals to a control processor and each transducer including a first part attached to the movable tool-holder beam and a second part attached to the auxiliary structure; and a control processor which receives signals from the position transducers and controls the actuators in such a manner that they impart identical displacements and displacement speeds to the beam;

wherein each actuator applies a working load between the connecting beam and the movable tool-holder beam.

2. A bending press according to claim 1, wherein the connecting beam is connected to the lateral uprights by means of an isostatic restraint system.

3. A bending press according to claim 1, wherein the connecting beam is disposed in the general common plane of the tool-holder beams.

4. A bending press according to claim 1, wherein the lateral uprights are disposed laterally outside the area of travel of the punch and the die.

5. A bending press according to claim 1, wherein it includes a guide structure connected to the lateral uprights on which guide structure the movable beam is mounted for sliding and on which the actuators are also mounted for sliding in the same direction of sliding as the movable beam.

6. A bending press according to claim 5, wherein the guide structure comprises essentially a beam connected to the lateral uprights and wherein the beam is provided with a plurality of guide units each of which slidably supports a respective actuator, the guide units acting as guides for the actuators and for the movable beam.

7. A bending press according to claim 5, wherein the second parts of said position transducers are supported by said guide structure.

8. A bending press according to claim 1, wherein the auxiliary structure bearing the position transducers has a plurality of generally C-shaped brackets associated with respective position transducers and disposed in a plane parallel to the general common plane of the tool-holder beams.

9. A bending press according to claim 1, wherein the movable beam is subdivided physically into separate successive modules, each corresponding to a segment.

10. A bending press according to claim 1, wherein the movable tool-holder beam is a continuous beam having a plurality of separation sections having a modulus of bending resistance in the general common plane of the tool-holder beams substantially lower than that of the remaining part of the beam.

11. A bending press according to claim 1, wherein the fixed tool-holder beam opposite the movable tool-holder beam is connected to the lateral uprights by means of an isostatic-type restraint system.

* * * * *